United States Patent [19]

McKay

[11] 4,062,083

[45] Dec. 13, 1977

[54] LINEAL SLIDE RETRACTABLE GROOMING BRUSH

[75] Inventor: Nicholas D. McKay, Grand Blanc, Mich.

[73] Assignee: Helmac Products Corporation, Flint, Mich.

[21] Appl. No.: 734,620

[22] Filed: Oct. 21, 1976

[51] Int. Cl.[2] ..... A46B 15/00; A46B 17/04; A47L 25/08

[52] U.S. Cl. ..... 15/106; 15/184; 15/17 G

[58] Field of Search ..... 15/106, 114, 169, 184, 15/258; 132/119, 121, 123

[56] References Cited

U.S. PATENT DOCUMENTS

| | | | |
|---|---|---|---|
| 815,798 | 3/1906 | Craven | 132/119 X |
| 1,414,042 | 4/1922 | Qvarnstrom | 132/119 |
| 1,696,727 | 12/1928 | Olmazu | 15/184 |
| 2,110,294 | 3/1938 | Gessner | 132/119 |
| 2,427,559 | 9/1947 | Johnson | 15/184 |
| 3,108,305 | 10/1963 | Peilet | 15/184 X |
| 3,594,841 | 7/1971 | Kieves | 15/106 X |
| 3,869,748 | 3/1975 | Krusche | 15/172 |

FOREIGN PATENT DOCUMENTS

| | | | |
|---|---|---|---|
| 652,155 | 10/1937 | Germany | 132/119 |

*Primary Examiner*—Daniel Blum
*Attorney, Agent, or Firm*—Miller, Morriss and Pappas

[57] ABSTRACT

A lineal slide retractable grooming brush consisting of a brush housing provided with a plurality of bristle openings in the bottom thereof and having a slide actuator control peg access slot along each side thereof. A bristle brush back plate member having a plurality of downwardly extending bristles is provided within the housing so that the bristles are in register with the bristle openings in the bottom of the brush housing. The bristle brush back plate member is provided with cam follower pins extending outwardly from each side thereof. A U-shaped slide actuator is slidably mounted within the brush housing so as to straddle the bristle brush back plate member in such a manner that the cam follower pins thereof slidably engage ramped cam grooves provided in the inside surface of the side walls of the slide actuator. The slide actuator is provided with control pegs which extend outwardly from the sides thereof through the control peg access slots provided in the sides of the brush housing. The control pegs are selectively movable along the access slots so as to cause corresponding lineal movement of the U-shaped slide actuator within the brush housing with a resultant selective raising and lowering of the bristle brush back plate member so as to selectively extend and retract the bristles through the bristle openings provided in the brush housing. The brush housing is also provided with a snap detachable plate having a clothes cleaning fabric brush pad provided thereon.

5 Claims, 27 Drawing Figures

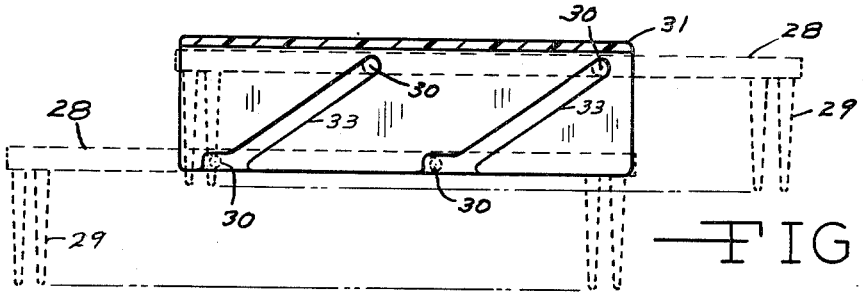
FIG 5
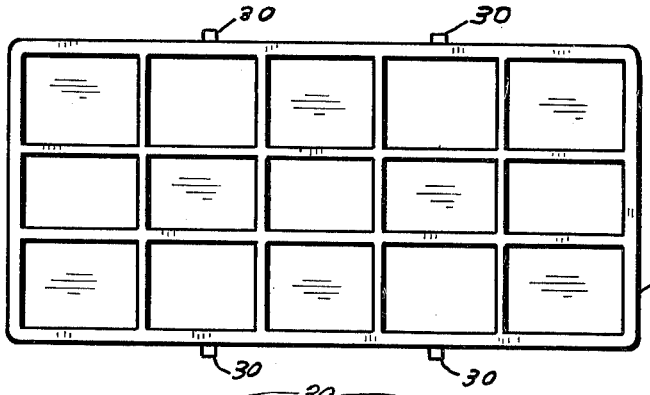
FIG 6
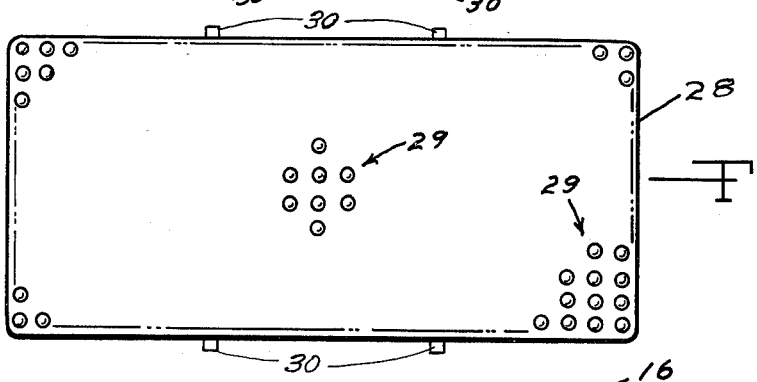
FIG 7
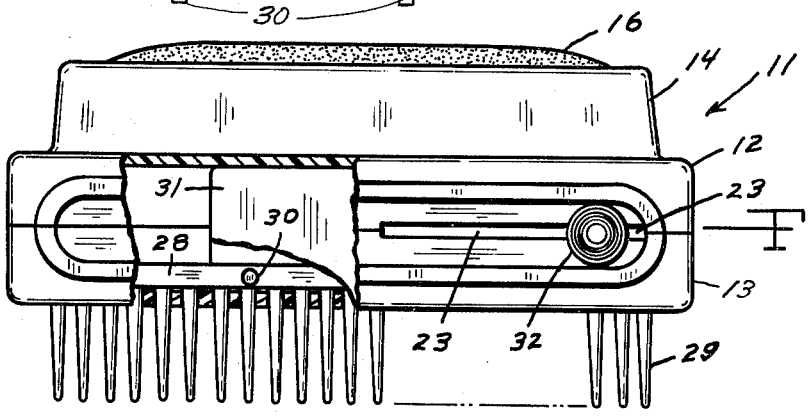
FIG 8
FIG 9
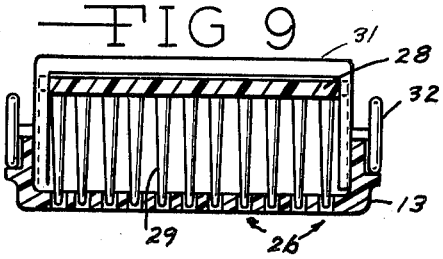
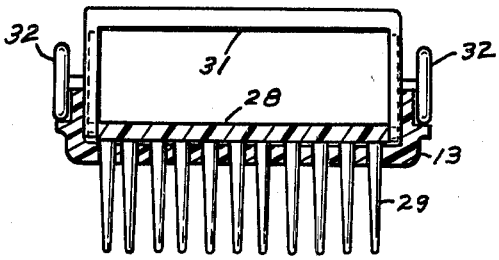
FIG 10

LINEAL SLIDE RETRACTABLE GROOMING BRUSH

SUMMARY OF THE INVENTION

This invention relates to lineal slide retractable grooming brush provided with selectively extendable and retractable bristles and having a snap detachable plate provided with a clothes cleaning fabric brush pad thereon. More specifically, this invention relates to a lineal slide retractable grooming brush consisting a brush housing provided with bristle openings in the bottom thereof and having a slide actuator control peg access slot along each side thereof. A bristle brush back plate member having a plurality of downwardly extending bristles is provided within the brush housing so that the bristles are in register with the bristle openings in the bottom of the brush housing. The bristle back plate member is provided with cam follower pins extending outwardly from each side thereof. A U-shaped slide actuator is slidable mounted within the brush housing so as to straddle the bristle brush back plate member is such manner that the cam follower pins thereof slidable engage ramped cam grooves provided in the inside surface of the side walls of the slide actuator. The slide actuator is provided with control pegs which extend outwardly from the sides thereof through the control peg access slots provided in the sides of the brush housing. The control pegs are selectively movable along the access slots so as to cause corresponding lineal movement of the U-shaped slide actuator within the brush housing with a resultant selective raising and lowering of the bristle back plate member so as to selectively extend and retract the bristles through the bristle openings provided in the brush housing. The brush housing is also provided with a snap detachable plate having clothes cleaning fabric brush pad provided thereon.

In devices of the known prior art, retractable bristle brushes consist of two part housings which rotate relative to each other to cause internally positioned bristles to selective extend from the retract into the housing. Inasmuch as such housings are handled directly during the brushing action, the bristles are inadvertently retracted during the brushing operation. Other non-rotary retractable bristle brushes in the known prior art utilize complicated linkage structures to selectively extend and retract the individual bristles. Such devices were not only expensive to produce, but encountered extensive maintenance problems in use. Further, the use of rotary housing portions in such prior art devices precluded the use of ancillary clothes cleaning fabric brush portions in connection therewith.

Representative of such prior art patents are U.S. Pat. Nos. 106,680; 201,051; 330,270; 2,529,927; 2,856,039; 2,981,965; 3,059,259 and 3,108,305.

Nowhere in the known prior art is there shown a lineal slide retractable grooming brush such as this claimed structure wherein a slide actuator is provided within the brush housing so as to selectively extend and retract the bristles through openings provided in the base of the housing without the relative movement or rotation of the brush housing itself. Not only does use of the internal slide actuator produce stability in the operation of the retractable brush, but it eliminates alignment problems which heretofore existed in the fabrication of the prior art structures. Further, the instant invention provides a fixed stable housing which permits the use of a snap detachable replaceable clothes cleaning fabric pad in association therewith.

It is therefore an object of this invention to provide a lineal slide retractable grooming brush having a lineally movable slide actuator provided therein which can be selectively actuated to selectively extend and retract bristles from within the brush housing.

Another object of this invention is to provide a lineal slide retractable grooming brush comprising a brush housing having slide actuator control peg access slots in the sides thereof to accomodate slide actuator control pegs extending outwardly therethrough from a slide actuator slidably positioned within the brush housing.

Yet another object of this invention is to provide a lineal slide retractable grooming brush comprising a unitary fixed brush housing containing a selectively raisable and lowerable cam-actuated bristle brush back plate member having downwardly extending bristles in register with bristle openings provided in the bottom of the brush housing.

Still another object of this invention is to provide a U-shaped slide actuator within a brush housing so as to straddle and operatively engage a bristle brush back plate member so as to selectively raise and lower the bristle brush back plate within the brush housing in response to selective lineal movement of the slide actuator within the housing.

A still further object of this invention is to provide a slide retractable bristle brush housing with a snap detachable plate having a clothes cleaning fabric brush pad provided thereon.

Other objects and advantages found in the construction of the invention will be apparent from a consideration of the following specification in connection with the appended claims and the accompanying drawings.

IN THE DRAWINGS

FIG. 5 is a schematic sectional view taken on line 5—5 of FIG. 4 showing the ramped cam grooves provided on the inside of each sidewall of the slide actuator.

FIG. 6 is a top view of the bristle brush back plate illustrating the cam follower pin extensions provided thereon.

FIG. 7 is a bottom view of the bristle brush back plate showing the plurality of bristles extending therefrom.

FIG. 8 is a side elevation view of the brush housing with a portion broken away to illustrate the relative positioning of the brush components with the bristles in their extended position.

FIG. 9 is a schematic end view taken on line 9—9 of FIG. 4 showing the slide actuator straddling the bristle brush back plate in its raised retracted position within the housing.

FIG. 10 is a schematic end view taken on line 10—10 of FIG. 4 showing the bristle back plate in its lowered position with the bristles extending outwardly through the bristle openings provided in the bottom of the brush housing.

GENERAL DESCRIPTION

Figure 1:
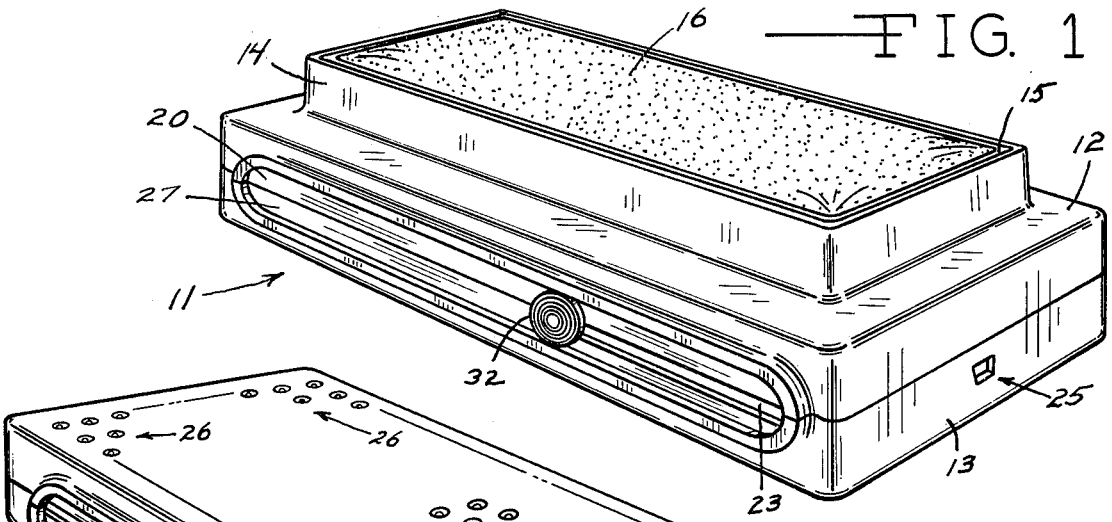
FIG. 1 is a top perspective view of the lineal slide retractable grooming brush showing the snap detachable clothes cleaning fabric pad at the top thereof.

In general, the lineal slide retractable brush consists of a brush housing having an elongate slide actuator control peg access slot along each side thereof. The brush housing is provided with a plurality of bristle openings in the base thereof. A bristle brush back plate member is provided within the housing and has a plurality of downwardly extending bristles in register with the bristle openings. The bristle brush back plate is provided with cam follower pins extending from each side thereof. A substantially U-shaped slide actuator is slidably mounted within the brush housing so as to straddle the bristle brush back plate member. The slide actuator is provided with inclined cam grooves along the inside surface of each of the side walls thereof. The cam grooves are adapted to operatively engage the cam follower pins of the bristle brush back plate member so that upon selective lineal movement of the slide actuator within the housing the bristle brush back plate member is selectively raised and lowered within the housing so as to selectively extend and retract the bristles through the bristle openings. The slide actuator is provided with control pegs which extend outwardly therefrom through the access slots of the housing so as to permit selective actuation of the slide actuator so as to selectively extend and retract the bristles through the bristle openings.

The brush housing is provided with a snap detachable plate receiving recess in the upper surface thereof and has a central connector pin receiving opening therein. A snap detachable plate is provided for mounting in the foregoing housing recess. The snap detachable plate is provided with a clothes cleaning fabric brush pad on the upper surface thereof and a dowel connector pin extending from the lower surface thereof. The dowel connector pin is adapted for snap engagement with the central connector pin receiving opening provided in the brush housing.

SPECIFIC DESCRIPTION

More specifically, the lineal slide retractable grooming brush 11 consists of an upper housing portion 12 and a lower housing portion 13 which are adapted for snap mating engagement with each other to form the overall brush housing 11. The housing portions 12 and 13 are formed from medium impact polystyrene. However any equivalent plastic can be utilized.

The upper housing 12 is provided with a central pedestal portion 14 which is adapted to supportably engage a snap detachable plate 15 having a clothes cleaning fabric brush pad 16 thereon. As shown more specifically in FIGS. 15 through 18, the central pedestal portion 14 of the upper housing 12 is provided with a recess 17 which is adapted to receive the snap detachable plate 15 therein. A central opening 18 is provided in the recess 17 which is adapted to receive the snap-in dowel connector 19 provided on the snap detachable plate 15. An elongate control peg recess 20 is provided along each side of the upper housing 12.

An elongate notched portion 21 is provided along each longitudinal edge of the upper housing 12. The notched portions 21 of the upper housing 12 are in register with similar notched portions 22 provided on the lower housing 13 so as to form an elongate control peg access slot 23 in each side of the slide retractable brush 11 when the upper and lower housings, 12 and 13 respectively, are in their mating use position to form the slide retractable brush 11. Resilient snap lock tabs 24 are provided at each end of the upper housing 12 which are adapted to make retentive locking engagement with appropriate detent openings 25 provided in the ends of the lower housing 13 so as to maintain the upper housing 12 and the lower housing 13 in their mating operative use position. In this position, the housing portions 12 and 13 are fixed and not movable relative to each other.

Figure 2:
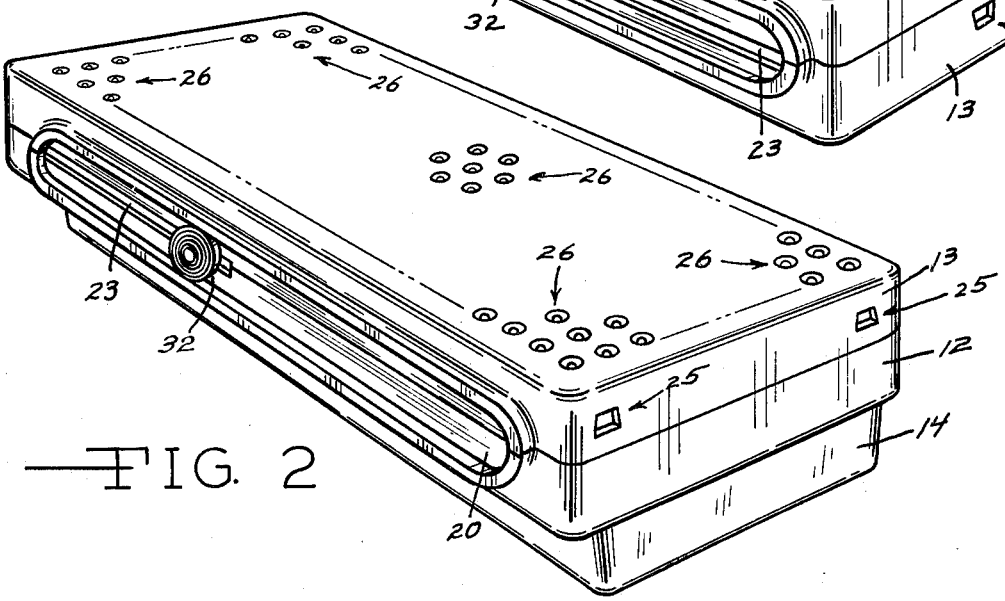
FIG. 2 is a bottom perspective view of the lineal slide retractable grooming brush showing the bristle openings in the bottom thereof.
Figure 3:
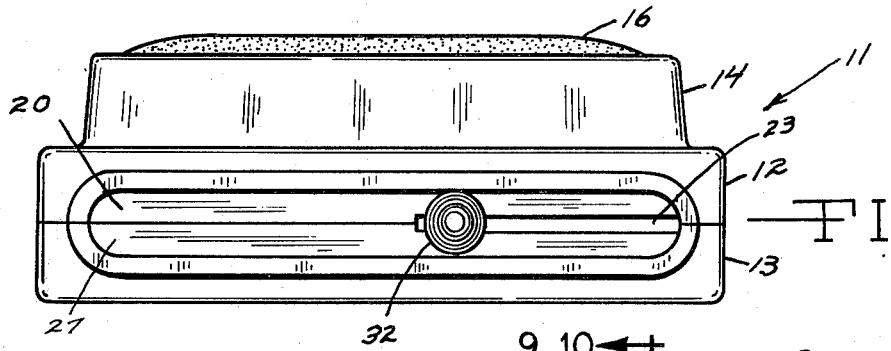
FIG. 3 is a side elevational view therof showing the slide actuator control peg access slot in the side thereof.
Figure 4:
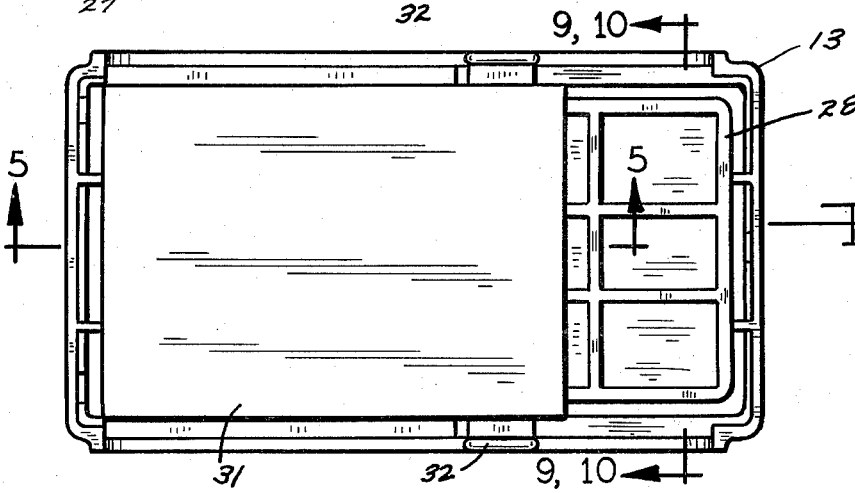
FIG. 4 is a top view of the bottom portion of the brush housing with the slide actuator and bristle brush back plate positioned therein.
Figure 11:
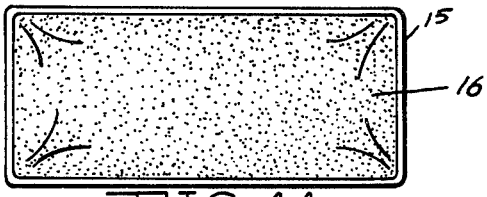
FIG. 11 is a top view of the snap detachable back plate showing the clothes cleaning fabric pad thereon.
Figure 12:
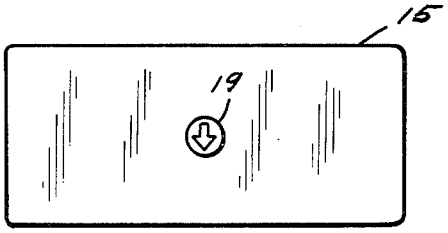
FIG. 12 is a bottom view thereof showing the snap-in dowel connector pin.
Figure 13:
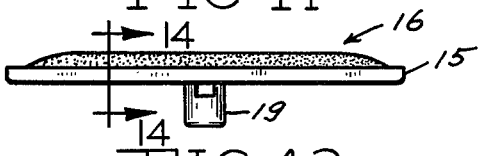
FIG. 13 is a side elevation view thereof.
Figure 14:
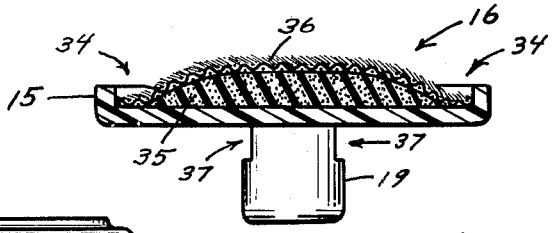
FIG. 14 is an enlarged cross-sectional view thereof taken on line 14—14 of FIG. 13 showing the clothes cleaning fabric pad provided thereon.
Figure 15:
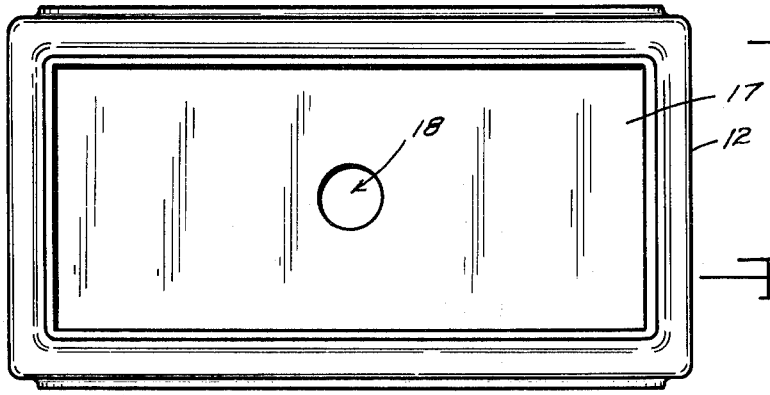
FIG. 15 is a top view of the upper brush housing showing the snap-in dowel connector pin receiving opening provided therein.
Figure 16:
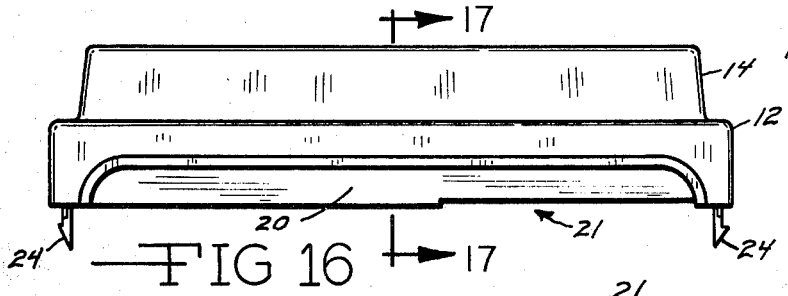
FIG. 16 is a side elevation view thereof.
Figure 17:
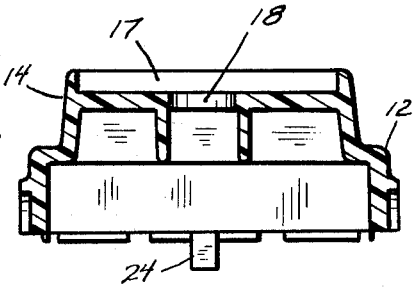
FIG. 17 is a cross-sectional view thereof taken on line 17—17 of FIG. 16.
Figure 18:
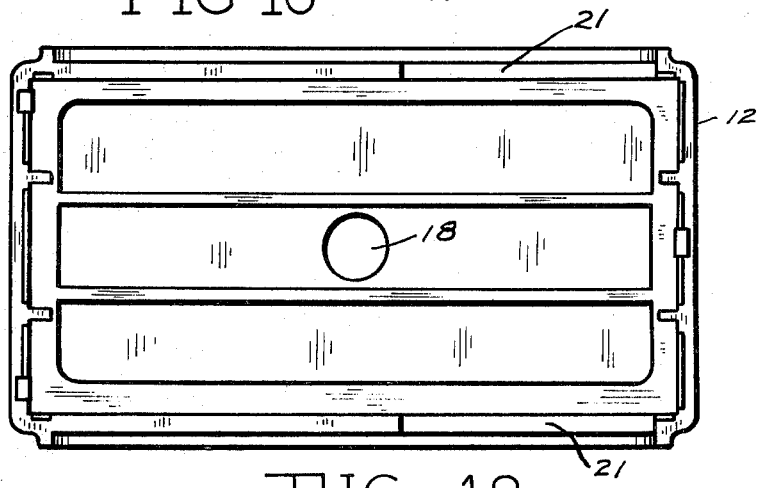
FIG. 18 is a bottom view thereof.
Figure 19:
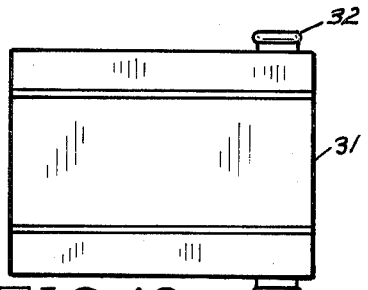
FIG. 19 is a top view of the slide actuator showing the control pegs extending outwardly thereupon.
Figure 20:
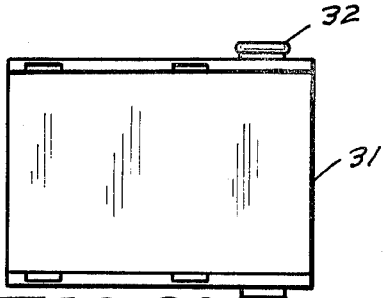
FIG. 20 is a bottom view thereof.
Figure 21:
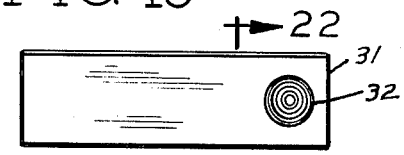
FIG. 21 is a side elevation view thereof.
Figure 22:
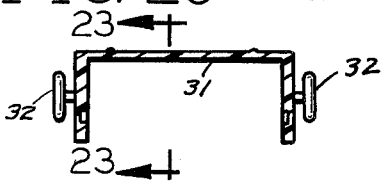
FIG. 22 is a cross-sectional view thereof taken on line 22—22 of FIG. 21.

As shown more specifically in FIGS. 24 through 27, the lower housing 13 is provided with a plurality of bristle openings 26 in the bottom surface thereof. Although only a representive number of openings 26 are shown in the drawings, the openings 26 cover substantially all of the bottom surface of the lower housing 13 within the area delineated by the phantom lines in FIGS. 2, 24 and 27. An elongate control peg recess 27 is provided along each side of the lower housing 13 which is co-extensive and in register with the elongate control peg recess 20 provided in the upper housing 12.

As shown in FIGS. 6 through 10, a bristle brush back plate member 28 is provided with a plurality of bristles 29 extending therefrom. Although only a representative number of bristles 29 are shown in FIG. 7, the bristles 29 actually cover all of the area delineated by the phantom lines. The bristle brush back plate member 28 is provided with a pair of spaced apart cam follower pins 30 extending outwardly from each side thereof.

Figure 23:
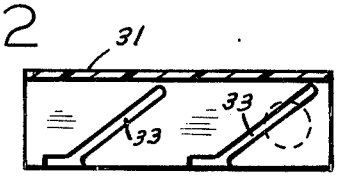
FIG. 23 is a cross-sectional view taken on line 23—23 of FIG. 22 showing the ramped cam grooves provided on the inside surface of each of the side walls of the slide actuator.
Figure 24:
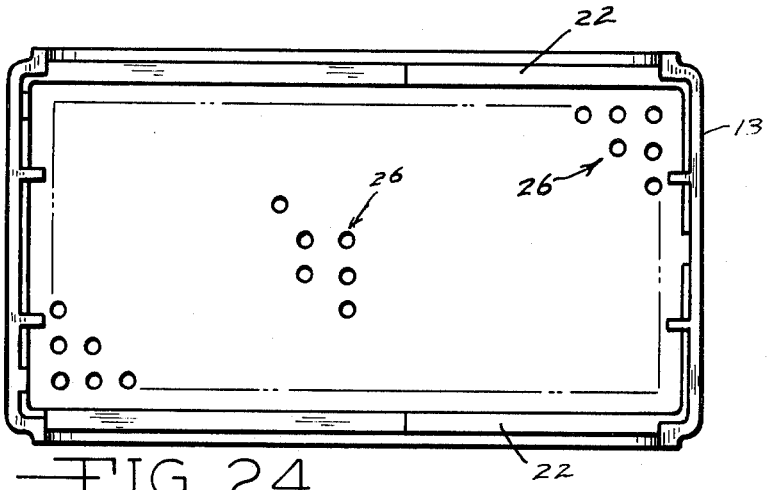
FIG. 24 is a top view of the lower housing showing the bristle openings provided therethrough.
Figure 25:
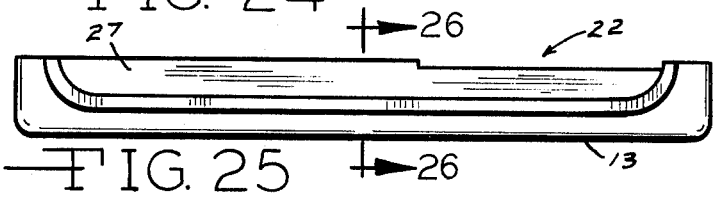
FIG. 25 is a side elevation view thereof.
Figure 26:
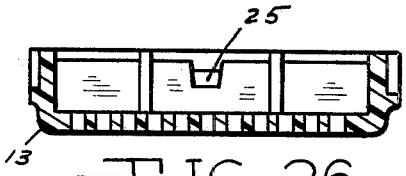
FIG. 26 is a cross-sectional view thereof taken on line 26—26 of FIG. 25.
Figure 27:
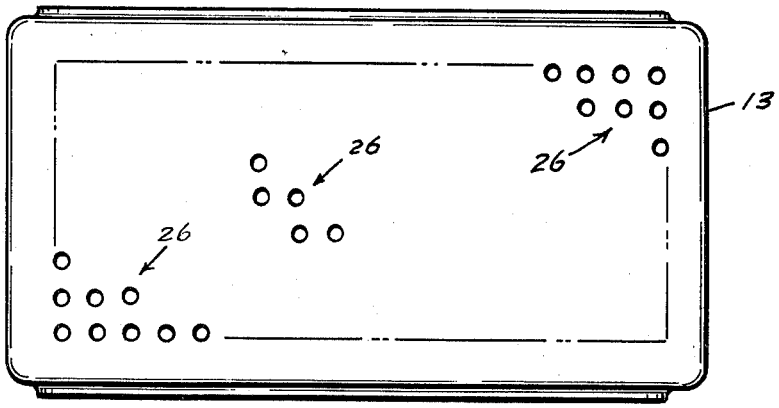
FIG. 27 is a bottom view thereof.

As shown specifically in FIGS. 19 through 23, a U-shaped slide actuator 31 is provided having fixed control pegs 32 extending outwardly from each side thereof. As shown in FIG. 23, a pair of cam grooves 33 are provided on the inside surface of each side thereof.

As shown in FIGS. 8, 9 and 10, the slide actuator 31 is adapted to be positioned within the grooming brush housing 11 as formed by the upper and lower housings 12 and 13. In its use position, the slide actuator 31 is positioned so that it straddles the bristle brush back plate member 28 within the lower housing 13. The upper housing 12 is then placed in snap lock engagement with the lower housing 13 so as to complete the brush housing 11. Thus positioned, the cam follower pins 30 of the bristle brush back plate member 28 are in operative engagement with the cam grooves 33 of the slide actuator 31. The control pegs 32 of the slide actuator 31 extend outwardly through the control peg access slots 23 provided in the brush housing 11. The slide actuator 31 can be moved lineally in either direction within the housing by moving the control pegs 32 as desired along the access slots 23. The lineal movement of the slide actuator 31 causes the bristle brush back plate member 28 to be selectively raised or lowered within the housing. The selective upward and downward movement of the back plate member 28 causes the bristles 29 thereof to be selectively extended and retracted through the openings 26 as shown in FIGS. 9 and 10. The interaction between the slide actuator 31 and the back plate member 28 is shown in FIG. 5 and is due to the movement of the cam follower pins 30 within the cam grooves 33. For purposes of clarity, the retracted (raised) and extended (lowered) positions of the bristle brush back plate (shown in phantom line) have been shown in an offset position. In actual use, the slide actuator 31 moves lineally within the housing while the bristle brush back plate 28 is merely retracted (raised) and extended (lowered) within the housing as described herein.

As shown in FIGS. 11 through 14, a snap detachable plate 15 is provided for selective mounting within the recess 17 provided in the upper housing 12. The snap detachable plate 15 is provided with a recess 34 in the upper surface thereof. A clothes cleaning fabric brush pad 16 is provided in the recess 34 and consists of a resident cushion 35 over which the brushing fabric 36 is stretched and heat sealed to the snap detachable plate 15. A central dowel connector pin 19 is provided on the surface of the snap detachable plate 15 opposite the brush pad 16. The connector pin 19 is provided with detents 37 at the base thereof so as to make snap engagement with the opening 18 in the upper housing 12.

It is thus seen that a highly utilitarian lineal slide retractable brush is provided wherein the housing portions are not movable relative to each other and complicated linkage arrangements are not required to selectively extend and retract the brush bristles from within the brush housing.

Various other modifications of the invention may be made without departing from the principle thereof. Each of the modifications is to be considered as included in the hereinafter appended claims, unless these claims by their language expressly provide otherwise.

I claim:

1. In a lineal slide retractable brush, the combination comprising:

a substantially rectangular brush housing, said brush housing provided with an elongate slide actuator control peg access slot along each side thereof, said brush housing provided with a plurality of bristle openings in the base thereof;

a substantially rectangular bristle brush back plate member provided within said housing, said bristle brush back plate member having a plurality of downwardly extending bristles in register with said bristle openings, said bristle brush back plate member provided with cam follower pins extending from each side thereof; and a substantially U-shaped slide actuator slidably mounted within said housing so as to straddle said bristle brush back plate member, said slide actuator provided with inclined cam grooves on the inside surface of each of the side walls thereof which are adapted to operatively engage said cam follower pins of said bristle brush back plate member, said slide actuator provided with control pegs which extend outwardly through said access slots of said housing so as to permit selective lineal movement of said slide actuator to raise and lower said bristle brush back plate member so as to selectively extend and retract said bristles through said bristle openings.

2. In the lineal slide retractable brush of claim 1 wherein said housing is provided with a snap detachable plate receiving recess in the upper surface thereof, said recess provided with a central connector pin receiving opening therein.

3. In the lineal slide retractable brush of claim 2 wherein a snap detachable plate is provided for mounting in said recess, said snap detachable plate provided with a clothes cleaning fabric brush pad thereon, said snap detachable plate having a dowel connector pin adapted for snap engagement with said connector pin receiving opening.

4. In the lineal slide retractable brush of claim 1 wherein a clothes cleaning fabric brush pad is provided on the upper surface of the brush housing.

5. In the lineal slide retractable brush of claim 1 wherein a snap detachable plate having a clothes cleaning fabric brush pad thereon is provided on the upper surface of the brush housing.

* * * * *